United States Patent [19]

Krebs

[11] 3,970,811

[45] July 20, 1976

[54] NOZZLE AND CONTACT ARRANGEMENT FOR PUFFER TYPE INTERRUPTER

[75] Inventor: Peter Krebs, Harleysville, Pa.

[73] Assignee: I-T-E Imperial Corporation, Spring House, Pa.

[22] Filed: Sept. 16, 1974

[21] Appl. No.: 506,426

[52] U.S. Cl. ..... 200/148 A; 200/150 G

[51] Int. Cl.[2] ..... H01H 33/88

[58] Field of Search ..... 200/148 A, 150 G

[56] References Cited

UNITED STATES PATENTS

| | | | |
|---|---|---|---|
| 3,639,712 | 2/1972 | Balmat et al. | 200/148 A |
| 3,665,134 | 5/1972 | Fischer | 200/148 A |
| 3,679,851 | 7/1972 | Latour et al. | 200/148 A |
| 3,786,215 | 1/1974 | Mauthe | 200/148 A |
| 3,839,613 | 10/1974 | Tsubaki et al. | 200/148 A |

*Primary Examiner*—Robert S. Macon

*Attorney, Agent, or Firm*—Ostrolenk, Faber, Gerb & Soffen

[57] ABSTRACT

The insulation nozzle of a puffer type breaker has flexible contact fingers disposed along the walls of the nozzle upstream of the gas flow path through the nozzle. The flexible contact fingers engage a hollow tubular stationary contact which extends through the nozzle orifice when the interrupter is closed. A central arcing contact is fixed to the flexible contact fingers within the nozzle and projects into the interior of the stationary tubular contact when the contacts are closed. A plurality of main finger contacts are connected to the stationary contact, and slidably engage an outer main movable contact sleeve fixed to the movable arcing contact and the insulation nozzle. The movable contact sleeve forms a bridging connection between the main terminals of the interrupter when the interrupter is closed. The main bridging contacts disengage before the interior contact fingers within the nozzle disengage the stationary contact tube so that the outer fingers do not interrupt power currents.

10 Claims, 6 Drawing Figures

FIG. 1
(PRIOR ART)
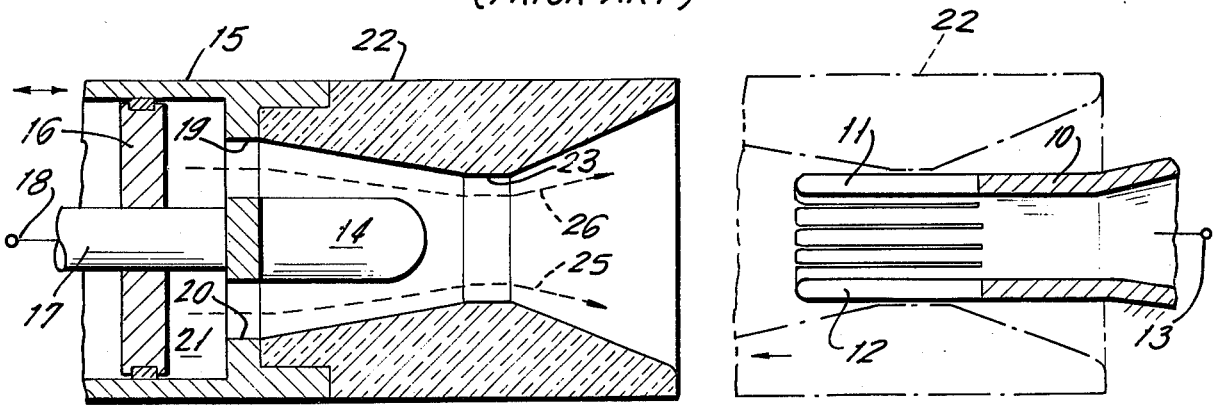
FIG. 2
(PRIOR ART)
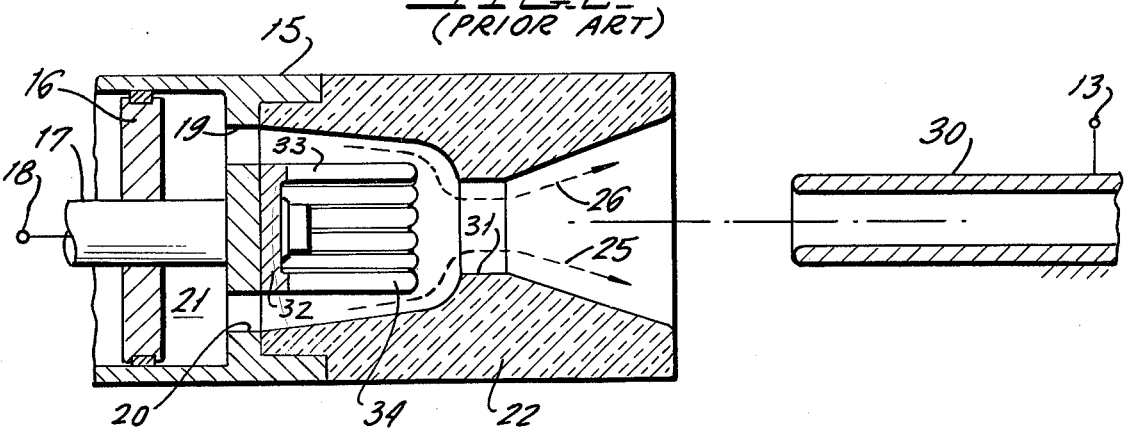
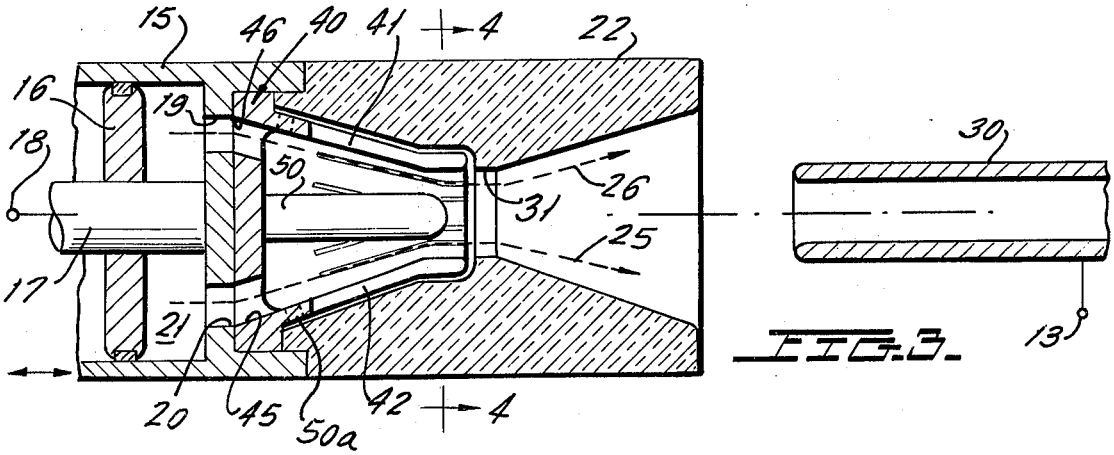
FIG. 3

NOZZLE AND CONTACT ARRANGEMENT FOR PUFFER TYPE INTERRUPTER

BACKGROUND OF THE INVENTION

This invention relates to puffer type circuit interrupters, and more specifically relates to a novel arcing contact configuration for puffer interrupters in which flexible finger contacts are contained adjacent the upstream surface of the nozzle of the puffer breaker and slidably engage a stationary contact tube which projects into the nozzle orifice when the breaker is closed.

Puffer type interrupters are well known in the art and generally consist of a pair of relatively movable contacts where one of the contacts is connected, for example, to a cylinder which moves over a stationary piston so that a blast of gas is produced when the contacts are opened. A nozzle is also connected to the movable contact to direct the gas blast in the most efficient manner to obtain cooling and interruption of the arc drawn between the separating contacts.

In contact arrangements which have been used in the prior art, the contacts conventionally engage one another at a point slightly upstream of an orifice restriction within the nozzle. When the contacts begin to move to an open position relative to one another, the prior art designs have permittted gas leakage during precompression of the volume between the contact fingers of the stationary arcing contact so that there is some pressure loss at the early part of the contact stroke. Moreover, prior art arrangements require a relatively large nozzle diameter when the stationary contact is designed as a finger contact which engages and encloses a stationary arcing contact positioned within the nozzle.

In order to avoid this problem, some arrangements in the prior art have made the contact member within the nozzle a finger type contact which engages a relatively small diameter tubular contact, thus permitting the use of a relatively small nozzle orifice. Devices of this type, however, have the disadvantage of a long upstream arc length and, moreover, the arc root on the contact within the nozzle is at a position which is not easily cooled by the flow of gas within the nozzle.

BRIEF DESCRIPTION OF THE PRESENT INVENTION

In accordance with the present invention, a novel contact and nozzle configuration is provided wherein segmented arcing contact fingers are disposed within and line the upstream wall of the nozzle and are closely spaced to the wall. The interior surface of the contact fingers then define the interior surface of the nozzle. This contact may contain a projecting central contact member, where the tulip contact and central projecting member enclose the outer and interior surfaces respectively of a stationary contact tube. Thus, the novel arrangement of the invention permits effective compression of gas during the initial movement of the nozzle and also maintains the arc between the separating contacts in a ring which is exposed to high speed gas movement during the interruption process.

BRIEF DESCRIPTION OF THE DRAWINGS

FIG. 1 schematically shows the contacts and nozzle of a prior art type interrupter in which the stationary contact is a segmented finger type contact.

FIG. 2 shows a prior art puffer type interrupter arrangement in which a segmented finger type contact is contained within the nozzle.

FIG. 3 schematically illustrates the novel invention wherein a segmented finger type contact arrangement is closely spaced to the upstream region of the nozzle and wherein a central conductive rod is contained within the nozzle interior.

DETAILED DESCRIPTION OF THE DRAWINGS

Figure 5:
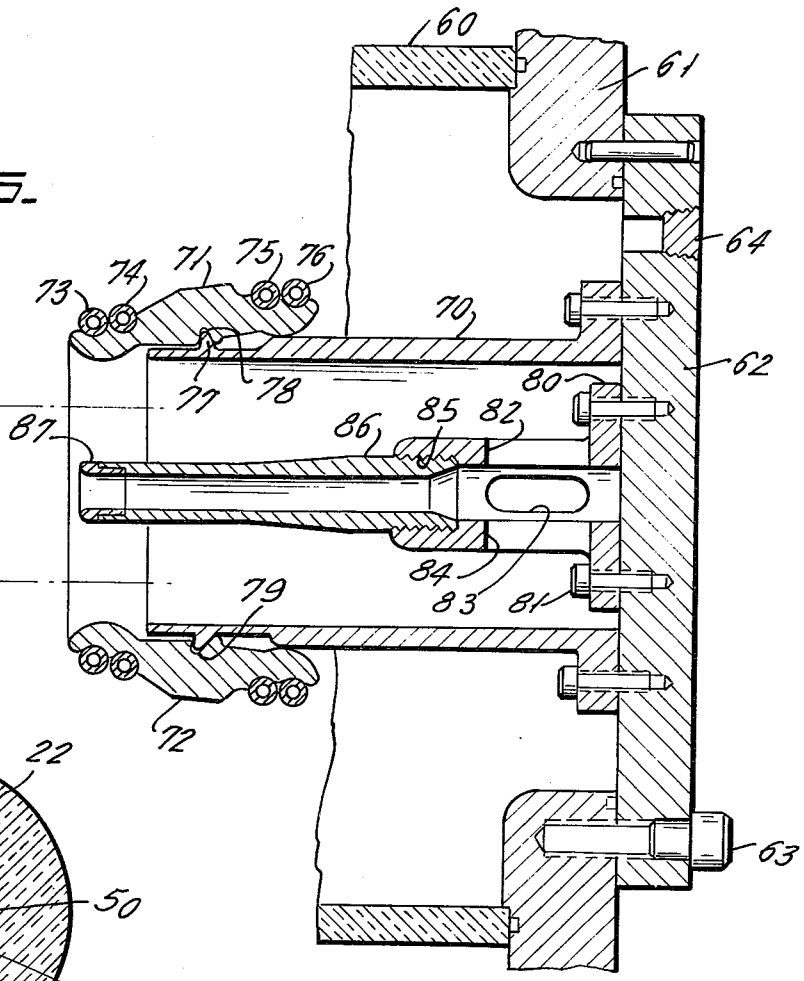
FIG. 5 is a cross-sectional view of a puffer type interrupter constructed in accordance with the schematic arrangement shown in FIGS. 3 and 4 where the interrupter contacts are open.

Referring first to FIG. 1, there is disclosed therein a prior art type of puffer interrupter arrangement wherein a stationary arcing contact 10 is formed with segmented contact fingers such as contact fingers 11 and 12 which are spread away from one another when the contacts of the interrupter are closed. A suitable terminal 13 is connected to the stationary contact 10.

The movable contact of the interrupter of FIG. 1 consists of the movable contact rod 14 which is fixed to cylinder 15 which moves over a stationary piston 16. A movable operating rod 17 extends slidably through the piston 16 and is fixed to the cylinder 15 and the contact rod 14. Operating rod 17 or cylinder 15 may be of conductive material and is connected to the second terminal 18 of the interrupter. The end of cylinder 15 is provided with suitable openings such as openings 19 and 20 which permit the flow of gas from the cylinder volume 21 which is compressed when the operating rod 17 is moved to the left in order to move the contacts to their open position shown in FIG. 1.

The nozzle 22 is then fixed to the cylinder 15 and thus to contact 14. Nozzle 22 is of any desired insulation material and contains a nozzle orifice 23. Orifice 23 has a diameter sufficiently large to receive the stationary contact 10 so that the stationary contact fingers 11 and 12 can slide over and engage the outer surface of the movable contact 14. The interrupter contacts and nozzle 22 are shown in the open position in solid lines in FIG. 1, and the nozzle 22 assumes the position shown in dotted lines when in the contact-closed position of the interrupter. When the contacts are moved to their open position, the volume 21 is compressed, producing gas flow in the direction of the dotted arrows 25 and 26. This gas will flow between the separating contacts 10 and 14, to cool the arc drawn therebetween. The apparatus of FIG. 1 will be immersed in any suitable gas which may be at atmospheric pressure. For example, sulfur hexafluoride or other electronegative gases can be contained within a container (not shown) which also receives the components of FIG. 1, with the gas being at atmospheric or at elevated pressure.

In the prior art arrangement of FIG. 1, during the initial movement of the contacts toward their open position, considerable gas will flow from the chamber 21 through the opening between fingers 11 and 12 to a region downstream of the orifice restriction 23. Thus, there is gas leakage during the precompression time so that the maximum desired gas flow from volume 21 will not be available during the arcing time when the contacts 10 and 14 have disengaged and have reached the preferred distance from one another where most effective arc interruption can occur. Moreover, the arrangement shown in FIG. 1 requires that the diameter of orifice 23 be large enough to receive the outer diameter of contact 10.

In order to overcome the above disadvantages, contact arrangements have been designed as shown in FIG. 2 wherein components similar to those of FIG. 1 have been given similar identifying numerals. Thus, in FIG. 2, the stationary contact has been changed to consist of a relatively small diameter tube 30 which passes through a smaller diameter orifice 31 in the nozzle 22. The movable contact member 14 of FIG. 1 is replaced by a tubular contact 32 in FIG. 2 which carries segmented fingers, such as fingers 33 and 34 corresponding to fingers 11 and 12 of FIG. 1. The segmented contact fingers of the contact member 32 then slidably receive the exterior surface of stationary contact 30 when the movable contact member 32 engages the stationary contact 30.

The design of FIG. 2, however, has disadvantages which do not exist in the arrangement of FIG. 1. Thus, the design forces a relatively long arc upstream to the left of orifice 31, thereby creating a relatively high arc energy. Moreover, the arc will tend to lengthen on the inside surfaces of contact fingers 33 and 34, while the gas flow from chamber 21, as represented by arrows 25 and 26, will be between the nozzle surface and the exterior surface of the contact 32. Thus, the arc roots will not be cooled effectively, thereby reducing the interrupting capability of the structure.

In accordance with the present invention, a novel configuration is provided for the arcing contacts of the interrupter which avoids the disadvantages of the designs of both FIGS. 1 and 2. The arrangement of the present invention is schematically illustrated in FIGS. 3 and 4, where components similar to those of FIGS. 1 and 2 have been given the same identifying numerals.

Figure 4:
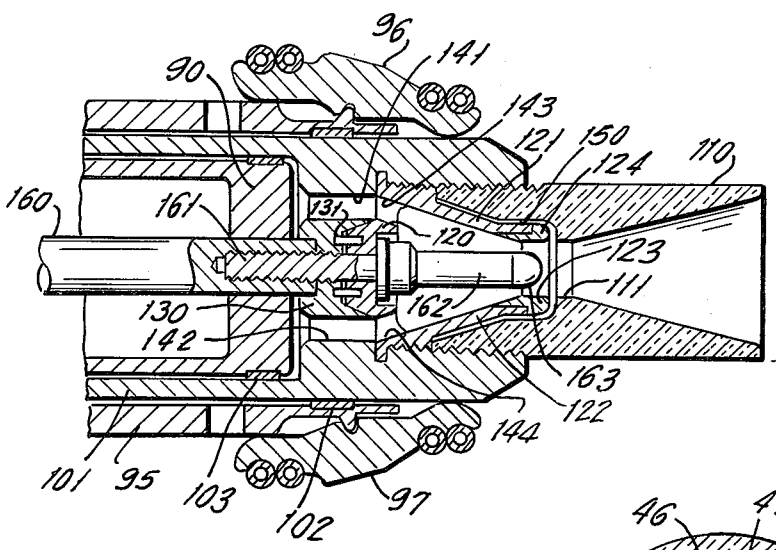
FIG. 4 is a cross-sectional view of FIG. 3 when taken across the section line 4—4 in FIG. 3.
Figure 4:
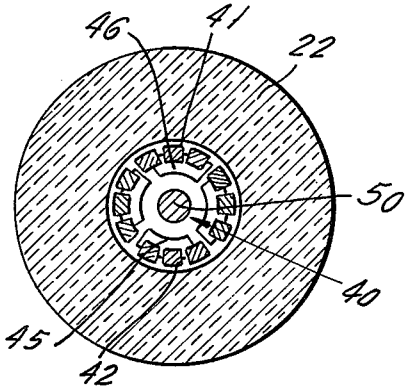

Referring now to FIGS. 3 and 4, the upstream surface of the nozzle 22 receives a generally conically shaped arcing contact member 40 which is terminated by segmented fingers such as fingers 41 and 42. The contact 40 and its fingers such as fingers 41 and 42 lie generally along the interior surface upstream of orifice 31 but are spaced from the interior surface by a distance sufficient only to allow the fingers to expand to receive the stationary contact tube 30.

Conical contact member 40 is further provided with suitable openings such as openings 45 and 46 which are in registry with openings 19 and 20 in the cylinder 15 so that gas can flow from chamber 21 through the nozzle orifice 31 during arc interruption. A central contact member 50 is also secured to contact member 40 and serves as an arcing contact for ultimately receiving an arc root during the arc interruption process. Note, however, that the contact arrangement of the invention can operate without the member 50.

During the closing operation of the interrupter shown in FIG. 3, the nozzle 22 and its contact 40 and cylinder 15 are moved to the right so that the contact tube enters orifice 31 and is suitably engaged on its outer surface by the contact fingers such as contact fingers 41 and 42 of the contact 40. The central contact member 50 also extends into the interior of contact tube 30.

In order to interrupt the current flowing from terminal 18 to terminal 13, the operating rod 17 is moved to the left, thereby to move cylinder 15, contact 40 and nozzle 22 to the left and toward the position shown in FIG. 3. This causes the volume 21 to reduce, thereby pressurizing the gas therein and forcing gas flow from volume 21 through openings 19, 20, 45 and 46 as indicated by the arrows 25 and 26. This gas flow will be seen to be through and along the arc which will root on the fingers 41 and 42 as contrasted to the arrangement of FIG. 2 where the arc root is removed from the gas flow path. Moreover, relatively little gas will be lost through the initial stroke of the contacts since the orifice 31 is blocked by the stationary contact tube 30. Therefore, the arrangement of FIG. 3 will have all of the advantages of the arrangements of FIGS. 1 and 2 without any of their disadvantages. If desired, other openings 50a can be formed in the contact 40 to tend to cause turbulence in the gas flow pattern.

Figure 6:
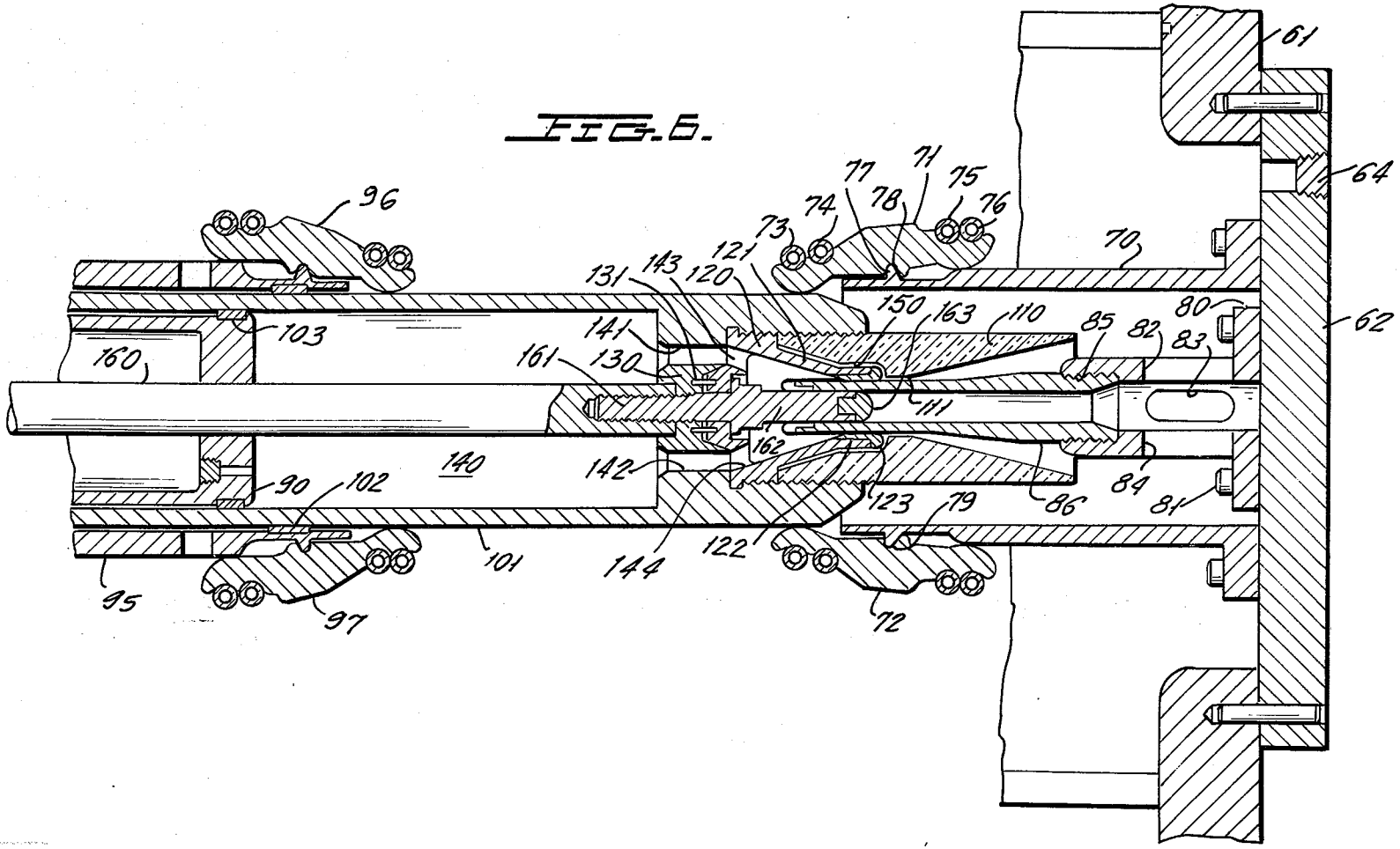
FIG. 6 is similar to FIG. 5 but shows the interrupter contacts closed.

FIGS. 5 and 6 show a puffer type interrupter which has been made using the concepts disclosed in FIGS. 3 and 4 for the arcing contacts of the interrupter, while using main current carrying contacts in parallel with the arcing contacts and which are not subject to arcing duty during operation.

Referring now to FIGS. 5 and 6, the puffer interrupter is shown in more detail and a portion of the housing for the device is also shown. Thus, an insulation tube 60 is provided which is enclosed at one end by the metallic disk 61 which has a metallic end plate 62 connected thereto. Note that the system could also be contained within a metal tank with bushings for the terminals. Suitable seals are provided between the insulation cylinder 60 and ring 61 and between the end plate 62 and the ring 61 to prevent the escape of gas such as SF6 or the like which is contained within chamber 60 at some single pressure which may be from atmospheric pressure to about eight atmospheres.

The plate 62 is bolted to disk 61 by bolts such as bolt 63 and is further provided with sealable openings such as sealed opening 64 which enables gas to be loaded into or withdrawn from the interior of the chamber 60. The left-hand end of chamber 60 is sealed in a manner similar to that described for the end plate 62 but which is not important to the present invention.

The plate 62 supports main stationary contact tube 70 which carries a plurality of tulip-clip type contact fingers, such as the contact fingers 71 and 72, which are held on the contact tube 70 by suitable garter springs such as the springs 73 to 76 which surround the axis of tube 70 and press contact fingers into high pressure engagement with tube 70. A raised ridge 77 is formed on the outer surface of contact tube 70 and engages depresssions 78 and 79 on the interior surface of fingers 71 and 72, respectively, so that the fingers can pivotally rotate around the ridge 77.

Plate 62 further mounts a stationary arcing contact cup 80 which is bolted thereto as by bolts 81, where the cup 80 has exhaust ports therein such as ports 82 to 84 and has a threaded interior end 85 which threadably receives the stationary contact tube 86. Stationary arcing contact tube 86 is a hollow tube which communicates with ports 82 to 84 and terminates with an arcing material tip 87. This then completes the stationary contact assembly of the interrupter.

The movable contact assembly in FIGS. 5 and 6 is movably supported on a stationary piston 90 where the piston 90 is fixed to an end plate (not shown) which is also fastened to the outer end of cylinder 60.

A stationary contact tube 95 which is similar in construction to stationary tube 70 associated with the stationary contact assembly is also stationarily mounted with the piston 90 and receives a plurality of contact fingers including fingers 96 and 97 which are constructed identically to the contact fingers 71 and 72 and are fixed on the tube 95 in a manner identical to the securement of fingers 71 and 72 of tube 70.

The main movable contact is then formed of a movable contact tube 101 which slides inside the tube 95 and is movably secured thereto by the sliding seal 102 which is fixed to the interior of stationary tube 95. The interior surface of movable contact tube 95 is slidably received over the fixed piston 90 by the sliding seal 103 which is fixed to the piston 90. It will be noted that the contact fingers such as contact fingers 96 and 97 are normally pressed into high pressure sliding engagement with contact tube 101 at one of their ends and into high pressure engagement with contact tube 95 at the other of their ends.

Suitable terminals are then connected to stationary contact tube 95 and to the stationary contact tube 70 such that the normal current path through the interrupter when it is closed in the position of FIG. 6 is from contact tube 95, through contact fingers 96 and 97, through movable contact tube 101, into contact fingers 71 and 72, and then through stationary contact tube 70 to the plate 62.

The movable contact tube 101 threadably receives an insulation nozzle 110 at its outer end where the nozzle 110 has an orifice 111 of reduced diameter which is just large enough to receive stationary arcing contact tube 86 as shown in FIG. 6.

A movable arcing contact cup 120 is also connected to the end of movable contact tube 101 where the cup 120 has a plurality of conically inwardly extending contact fingers, such as contact fingers 121 and 122 which are suitably terminated with arcing contact tips 123 and 124, respectively. The cupshaped arcing contact 120 then has an outwardly dished bottom section which is received by the interior shoulder 130 of the contact tube 101. Note that a pin 131 may be used to align the cup 120 with the shoulder 130 so that the apertures in the cup and in the shoulder are aligned with one another to allow gas flow from the chamber 140 (FIG. 6) to pass through the aligned openings and in through the orifice 111 of nozzle 110. Thus, shoulder 130 contains openings or slots 141 and 142 extending around its diameter which are in alignment with similar openings or slots 143 and 144, respectively, in the movable contact 120.

It will be noted that the arcing contact fingers such as fingers 121 and 122 are arranged to nest into a conforming depression 150 in the upstream side of the nozzle 110. Moreover, the interior diameter formed by the ends of the contact fingers including contact fingers 121 and 122 will be slightly smaller than the exterior diameter of stationary contact tube 86 so that the fingers will be outwardly deflected when the contacts are engaged in order to create the desired contact pressure needed for low resistance connection between the contacts. Note that the contact fingers 121 and 122 are sufficiently spaced from the interior of the adjacent nozzle wall to allow the fingers to deflect outwardly when contact engagement is made.

An operating shaft 160 is connected to a suitable operating mechanism and is movable along the axis of the interrupter from the position shown in FIG. 6 to the position shown in FIG. 5. The shaft 160 is connected to the shoulder 130 of movable contact tube 101 and to the movable arcing contact 120 by means of a bolt 161. The bolt 161 may have a further extension 162 which defines a further arcing contact extension for the movable arcing contact and is terminated with an arcing tip 163. Note that, in the position of FIG. 6, the extension 162 is nested into the interior of stationary arcing contact tube 86.

When the puffer interrupter is closed, a first main current path exists through the contact fingers 96 and 97 and fingers 71 and 72 to connect main contact tubes 70 and 95 by the bridging movable contact 101. A parallel current path exists through the stationary arcing contact 86, the movable arcing contact 121, the movable contact tube 101 and the main contact tube 95.

To open the interrupter, a suitable operating mechanism (not shown) is connected to the operating shaft 160 and moves the operating shaft 160 to the left in FIGS. 5 and 6. The movement of operating rod 160 causes the main movable contact tube 101 to move to the left so that its end disengages from the contact fingers such as contact fingers 71 and 72. The current through this main current path then commutates into the main movable arcing contacts, including contact fingers 121 and 122 and into the stationary arcing contact tube 86.

The continued movement of shaft 160 eventually causes the disengagement of the movable arcing contact 120 from the stationary arcing contact tube 86 and an arc is then drawn from the end of arcing contact 86 to the interior surface of the contact fingers of arcing contact 120. At the same time, the volume 140 is being compressed and the gas pressure therein increases to initiate a flow of gas through the channels such as channels 141 and 142 and the aligned channels 143 and 144, respectively, and into the interior of nozzle 110. This gas flow, however, is restricted until the center of orifice 111 is unblocked by the stationary arcing tube 86 and the extension 162 therein.

Once the contact stroke has become sufficiently large, this gas pressure is released and arc extinguishing gas flows through and along the arc drawn between the arcing contacts in order to extinguish the arc. Note that this gas can flow into the tube 86 in order to provide a desirable axial flow of gas during the interruption operation.

After the interruption of the arc, the contacts continue to move until the interrupter reaches its fully open position as shown in FIG. 5. In order to reclose the interrupter, the operating rod 160 is simply moved in the opposite direction until the contacts resume their position of FIG. 6.

Although there has been described a preferred emobidment of this invention, many variations and modifications will now be apparent to those skilled in the art. Therefore, this invention is to be limited, not by the specific disclosure herein, but only by the appended claims.

The embodiments of the invention in which an exclusive privilege or or property is claimed are defined as follows:

1. A puffer interrupter comprising, in combination:
a stationary contact comprising an elongated tube;
a movable contact comprising a plurality of flexible contact fingers disposed in the form of an inwardly tapering truncated cone, a first end of each said fingers arranged to form an opening at the narrower end of said movable contact to axially telescope over the end of said stationary contact elongated tube to make contact with the outer surface of said tube;

a piston means and a cylinder means relatively movable with respect to one another to produce gas movement, one of said piston and cylinder means being connected to and movable with said movable contact;

a movable operating rod connected to said movable contact for moving said movable contact relative to said stationary contact and for producing movement of gas by said piston means and said cylinder means;

an insulation nozzle secured to and movable with said movable contact for guiding the flow of gas therethrough during the opening of said movable and stationary contacts, said insulation nozzle surrounding said movable contact and having an interior orifice restriction having a diameter just larger than the outer diameter of said stationary contact elongated tube;

said movable contact being positioned within said nozzle and disposed on one side of said orifice restriction and along the interior surface of said nozzle with said fingers tapering from one end of said nozzle to said orifice restriction; said nozzle being axially movable with said movable contact to an engaged position such that said stationary contact tube moves into said nozzle, through said orifice restriction, and into engagement with said movable contact;

said piston means and said cylinder means being disposed adjacent said movable contact and forcing gas flow substantially completely through the entire volume defined by said conically disposed contact fingers and along the interior surfaces of each of said fingers and into and through said orifice restriction when said movable contact is moved away from said stationary contact said one side of said orifice restriction within which said movable contact is disposed being the side which is downstream of the movement of gas through said orifice restriction; the other side of the interior of said nozzle being upstream of said gas flow and comprising an insulation surface and allowing the creation of an upstream arc during interruption operation.

2. The device of claim 1 wherein said movable contact is continuous with and in part defines the interior surface of said nozzle.

3. The device of claim 1 wherein said stationary contact elongated tube is hollow.

4. The device of claim 3 wherein said movable contact has a central axial extension therein which projects into the interior of said hollow elongated tube when said movable and stationary contacts are engaged.

5. The device of claim 1 which further includes a sealed housing for containing and supporting said interrupter, and an electronegative gas at a single given pressure filling said sealed housing, and filling said cylinder means.

6. The device of claim 5 wherein said piston means is fixed and wherein said cylinder means is fixed to and moves with said movable contact and said operating rod.

7. The device of claim 6 wherein said stationary contact elongated tube is hollow.

8. The device of claim 7 wherein said movable contact has a central axial extension therein which projects into the interior of said hollow elongated tube when said movable and stationary contacts are engaged.

9. A movable insulation nozzle and movable contact for a puffer interrupter, said movable nozzle comprising an axially elongated hollow cylinder of insulation material; the interior surface of said hollow cylinder having a central reduced diameter region defining an orifice restriction; the interior surface of said cylinder having upstream and downstream portions flaring smoothly outwardly from said orifice restriction to one end of said cylinder and to the opposite end of said cylinder respectively; said movable contact including a plurality of generally conically disposed flexible contact fingers axially extending through and substantially flush with said upstream portion of said cylinder and defining a gas flow guiding surface within said nozzle, said plurality of fingers being joined together at said one end of said cylinder; said downstream portion having a fully insulated surface.

10. The device of claim 9 which further includes an axially positioned movable contact member connected to said contact fingers and disposed on the axis of said cylinder and extending from said one end of said cylinder to said orifice restriction.

* * * * *